US008662006B1

(12) United States Patent
Patzer et al.

(10) Patent No.: US 8,662,006 B1
(45) Date of Patent: Mar. 4, 2014

(54) AFTER-MARKET DISHWASHER STATUS INDICATOR

(75) Inventors: Charles R. Patzer, Columbus, OH (US); James L. Kennedy, Columbus, OH (US); Ellen M. Brown, Columbus, OH (US)

(73) Assignee: Next Future, LLC, Dublin, OH (US)

( * ) Notice: Subject to any disclaimer, the term of this patent is extended or adjusted under 35 U.S.C. 154(b) by 70 days.

(21) Appl. No.: 13/600,617

(22) Filed: Aug. 31, 2012

Related U.S. Application Data

(63) Continuation-in-part of application No. 29/429,309, filed on Aug. 9, 2012.

(51) Int. Cl.
*G09F 11/18* (2006.01)

(52) U.S. Cl.
USPC ..... 116/321; D32/3

(58) Field of Classification Search
USPC ..... 116/306, 321–324; 40/1.6; D20/10, 18, D20/19, 22; D32/3
See application file for complete search history.

(56) References Cited

U.S. PATENT DOCUMENTS

| | | | | | |
|---|---|---|---|---|---|
| 4,703,712 | A | * | 11/1987 | Christman | 116/324 |
| D345,829 | S | * | 4/1994 | Mancuso et al. | D32/3 |
| 5,839,458 | A | * | 11/1998 | Delcarson | 134/113 |
| 7,363,738 | B2 | * | 4/2008 | Burtch | 40/491 |

* cited by examiner

*Primary Examiner* — Daniel S Larkin
*Assistant Examiner* — Irving A Campbell
(74) *Attorney, Agent, or Firm* — Hahn, Loser & Parks LLP; Rex W. Miller, II

(57) ABSTRACT

An after-market dishwasher stats indicator has a housing and an indicator member slidable therein. The housing has left and right end openings and a rear aspect or wall to be held at the dishwasher door front and a top wall extending obliquely therefrom with a viewing window such that indicia on the indicator member is viewable through the viewing window by a user standing astride the dishwasher. The member has first and second different indicia thereon, one indicative of a clean status of the dishwasher and the other indicative of a dirty or ready to be loaded status of the dishwasher. The different indicia are separately viewable through the viewing window depending on the position of the member, such that when the rear aspect is held to the dishwasher door front, the selected indicia is viewable to a user standing astride the dishwasher door front.

20 Claims, 5 Drawing Sheets

AFTER-MARKET DISHWASHER STATUS INDICATOR

RELATED APPLICATIONS

This application is a continuation-in-part of U.S. patent application Ser. No. 29/429,309, filed Aug. 9, 2012, the disclosure of which is incorporated herein by reference in its entirety.

FIELD OF THE INVENTION

The present invention relates to an after-market dishwasher indicator that can be removably placed on a dishwasher door and manipulated to indicate the status of a dishwasher such as whether dishes loaded therein are clean or dirty.

BACKGROUND

A common challenge for dishwasher users is identifying whether dishes that are in a dishwasher are clean or dirty. It is often difficult to tell, or perhaps to remember, whether the dishwasher has been run or if the dishes in the dishwasher are still dirty. The resulting confusion is increased in settings in which more than one person loads and/or unloads the dishes from the dishwasher. The problems are exacerbated with new models of dishwashers which provide indicators or controls across the top of the door, rather than on the front of the dishwasher door. Many times, the top of the door is not readily visible when the door is closed because the kitchen counter overlies the door top. Consequently, users may inadvertently load dirty dishes into a dishwasher otherwise containing clean dishes, or may remove dirty dishes for use or storage thinking they are already clean.

After-market dishwasher status indicators help reduce the confusion and problems noted above. Such after-market indicators are designed to be removably held to the dishwasher door front and manipulated by a user to indicate if the dishwasher has been or is being run (i.e., the dishes therein are clean) or not (i.e., the dishes therein are dirty). One after-market indicator is a vinyl or similar material petal-shaped member with a magnet therein to facilitate removably holding the indicator to the metal door of the dishwasher. One side of the indicator bears indicia, such as a green color and/or wording to indicate that the dishes are clean, and the other side bears different indicia, such as an orange color and/or wording to indicate that the dishes are dirty. The indicator can be placed against the door with the appropriate side showing and can be removed and flipped over and reapplied to the door to reveal the other side, depending on the status of the dishwasher.

The petal-shaped member indicator has certain drawbacks. For example, the magnet does not work with modern stainless steel door dishwashers. Further, the indicator can be easily knocked loose from the door, especially if it is soiled from use, leaving the user uncertain as to the status of the dishes in the dishwasher. Moreover, these indicators require significant handling in use making them prone to excessive soiling, wear, and tear. These indicators are also generally flat or planar, making them difficult to view when standing astride the dishwasher.

Another indicator is a rotatable indicator held to the dishwasher door with a suction cup. The rotatable indicator is a flat disc that can be rotated between 180 degree positions so that the indicia of interest is on the top and the indicia not of interest is on the bottom. These indicators may not be easily deciphered or controllable in terms of what status is to be displayed. And, as with the petal-shaped indicators, are generally flat/planar, and so are not easily viewed when the user stands astride the dishwasher. Nor is it clear how they can be cleaned.

SUMMARY OF THE INVENTION

The present invention provides an after-market dishwasher status indicator that overcomes the above-mentioned drawbacks of petal-shaped and suction cup-based after-market indicators. To that end and in accordance with the principles of the present invention, an after-market dishwasher status indicator is provided having a housing and an indicator member slidable therein, with the housing having left and right end openings and a rear aspect or wall to be held at the dishwasher door front and a top wall extending obliquely therefrom and including a viewing window such that indicia on the indicator member is viewable through the viewing window by a user standing astride the dishwasher. The indicator member is slidably positioned between the rear aspect, the top wall, and the left and right end openings with a left end of the member being accessible at the left end opening of the housing and the right end of the member being accessible at the right end opening of the housing to facilitate sliding the member within the housing by manual pressure applied to the left or right ends of the member. The member has first and second different indicia thereon, one indicative of a clean status of the dishwasher and the other indicative of a dirty or ready to be loaded status of the dishwasher. The different indicia are separately viewable through the viewing window depending on the position of the member, such that when the rear aspect is held to the dishwasher door front, the selected indicia is viewable to a user standing astride the dishwasher door front.

In a particular embodiment, the housing and member have generally complementary V-shaped or triangular cross-sections, and the member has a midsection with the indicia that is smaller in width than the distance between the openings of the housing, but is larger in cross-section than the openings, so that the member can be slid between, but not beyond, the openings. The left and right ends of the member may make up segments that are smaller than the midsection so as to fit through the end openings to expose the end segments for manual manipulation to facilitate sliding the member between positions to reveal the selected indicia in the viewing window.

Further, the slidable member may have upper and lower walls, but be open along the back aspect thereof to facilitate passage of fluid into and out of the back side of the member. The housing and member are made of dishwasher safe material. As a consequence, the indicator can be cleaned, such as in a dishwasher cleaning cycle, if desired.

The indicator advantageously also includes a mounting member associated with the rear aspect of the housing by which to removably hold the indicator to the dishwasher door front. The mounting member may be a magnet, a suction cup, an aspect of a hook and loop fastener (the other aspect being attached to the dishwasher door front), or a restickable tape. An adhesive may be used to secure the mounting member to the rear aspect of the housing. The mounting member is advantageously dishwasher safe as well to facilitate easy cleaning of the indicator.

By virtue of the foregoing, there is thus provided an after-market dishwasher status indicator that overcomes drawbacks of petal-shaped and suction cup-based after-market indicators. These and other advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the drawings given below, serve to explain the principles of the invention.

DETAILED DESCRIPTION OF THE DRAWINGS

Figure 6:
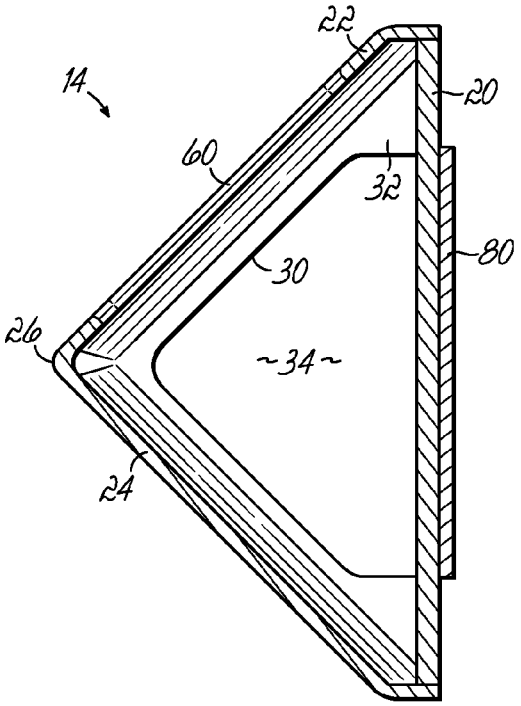
FIG. 6 is a cross-sectional view of the housing of the indicator of FIG. 1 taken along line 6-6 of FIG. 5.
Figure 7:
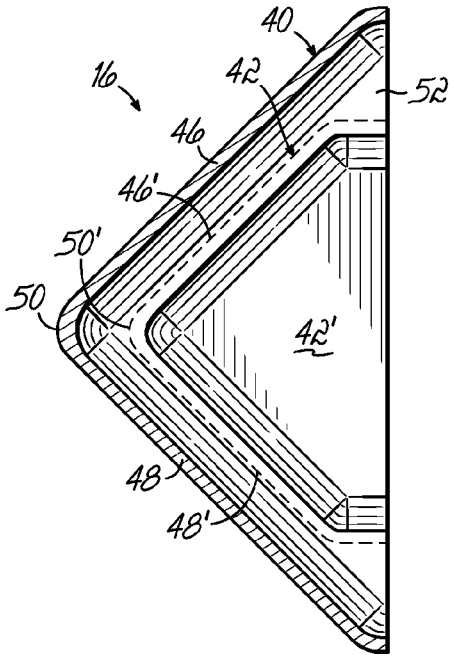
FIG. 7 is a cross-sectional view of the slidable member of the indicator of FIG. 1 taken along line 7-7 of FIG. 5.

With reference to the Figures, there is shown an illustrative embodiment of an after-market dishwasher status indicator 10 for displaying the status of a dishwasher 12 (FIG. 7) according to the principles of the invention. Indicator 10 includes a housing 14 and an elongated indicator member 16 slidably positioned therein. The housing 14 and the member 16 may be formed by injection molding of dishwasher safe plastic. The housing 14 has a rear aspect 20, which may be a solid, generally flat wall or a frame-like opening (not shown), and a top wall 22 extending obliquely therefrom, advantageously at an acute angle such as 45 degrees. The housing 14 also has a bottom wall 24 extending obliquely from the rear aspect 20 and joining top wall 22 as at 26 to thus define a V-shaped (when just the walls 22 and 24 are considered) or triangular (when walls 20, 22, and 24 are considered) cross-section to the housing 14 (FIG. 6). The rear aspect 20 may be a separate wall 20 (FIG. 5) to be secured to the walls 22 and 24, or may be hingedly attached to one of the walls 22, 24 and secured to the other of the walls 22, 24 such as by a snap fit or the like.

The rear aspect 20, and the top and bottom walls 22, 24, extend between left and right side end openings 30, 31 of the housing 14. The openings 30, 31 are defined by respective frame segments 32, 33 of the housing 14 so as to also be V-shaped or triangular in cross-section. The area 34 of the housing between frame segments 32 and 33 has a vertical elevation and a horizontal width that is larger than the end openings 30, 31.

Figure 5:
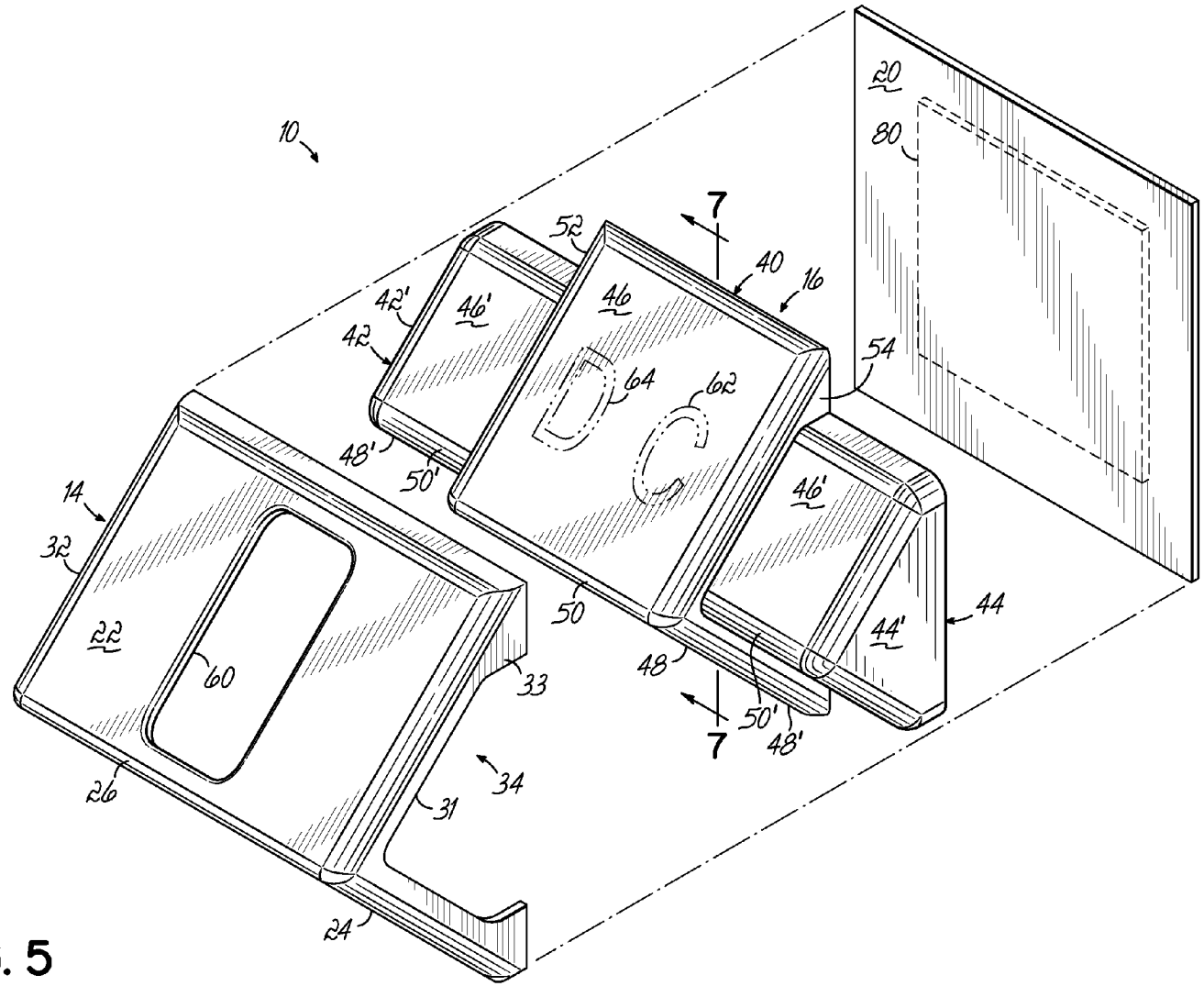
FIG. 5 is an exploded view of the indicator of FIG. 1.

The indicator member 16 advantageously has a midsection 40 and left and right segments 42, 44 as best seen in FIG. 5. The midsection 40 has an upper wall 46 and a lower wall 48 which join as at 50, but without a back wall to define a V-shaped cross-section of the midsection 40. The vertical size and the shape of midsection 40 is complementary to that of area 34 of the housing 14 such that the upper and lower walls 46, 48 confront the respective top and bottom walls 22, 24 of the housing 14. The horizontal size, i.e., the width, of the midsection 40 is smaller between the left and right segments 42, 44 than the horizontal width of the area 34 of the housing 14. Moreover, the midsection vertical size is larger than the end openings 30, 31 of the housing 14. As a consequence, the member 16 is slidable within the housing 14 through the area 34 between but not beyond the end openings 30, 31.

The left and right end segments 42, 44 also each have upper and lower walls 46', 48' which join as at 50' to define a V-shaped cross section sized to fit through end openings 30, 31, respectively. The left and right end segments 42, 44 define left and right ends 42', 44' which are accessible at end openings 30, 31, respectively. End segments 42, 44 may extend beyond end openings 30, 31. As will thus be appreciated, end segments 42, 44 adjoin midsection 40 at shoulders 52, 54 which may abut against end frames 32, 33, respectively, to limit sliding motion of the member 16 relative to the housing 14. The end segments 42, 44, like the midsection 40, also do not require a back wall. As a consequence, the entire backside of the member 16 is accessible for fluid to flow therethrough. The accessibility of the backside of the member 16 facilitates cleaning of the indicator 10, such as by running it through a cleaning cycle of the dishwasher 12.

The top wall 22 of the housing 14 includes a viewing window 60, which may be an open aperture formed in the top wall 22 during injection molding and may additionally include a lens (not shown). The viewing window 60 is advantageously centered in the topwall 22. Supported on the upper wall 46 of the midsection 40 are first and second, different indicia 62, 64. The indicia 62, 64 are advantageously laterally adjacent one another between the left and right end segments 42, 44 and are each sized to substantially occupy the viewing window 60. To that end, the lateral width of each indicia 62, 64 is typically no more than the lateral width of the viewing window 60 so that when the midsection 40 is moved between the frame segments 32, 33, only one of the indicia 62 or 64 is visible. Thus, it will be appreciated that the midsection 40 has a lateral width about equal to the width of area 34 less the width of one of the indicia 62, 64.

Figure 1:
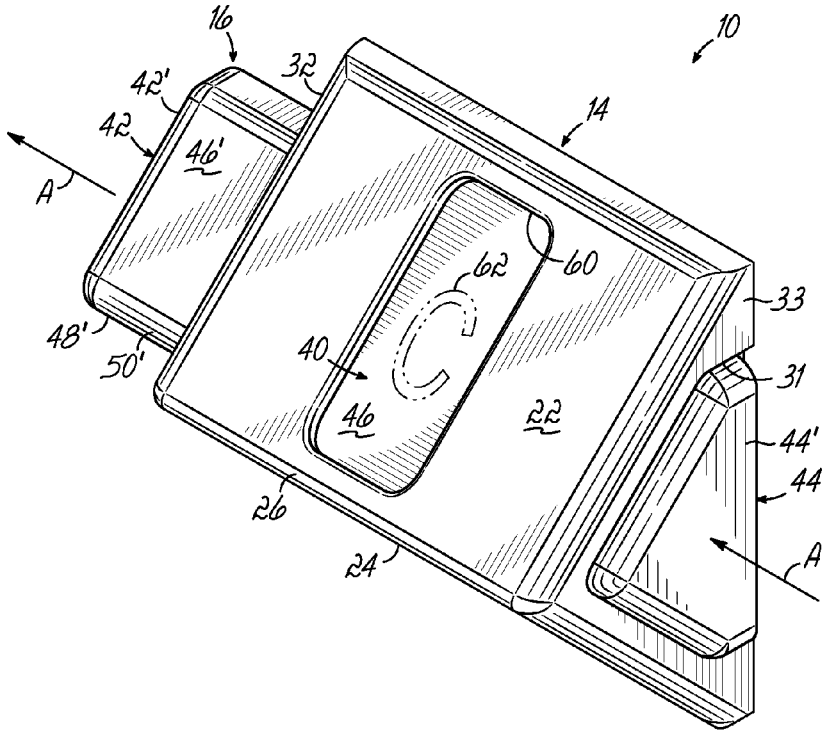
FIG. 1 is a perspective view of an illustrative embodiment of an after-market dishwasher status indicator with the slidable member positioned to display an indicia indicative of a clean status of a dishwasher status in accordance with the principles of the present invention.
Figure 2:
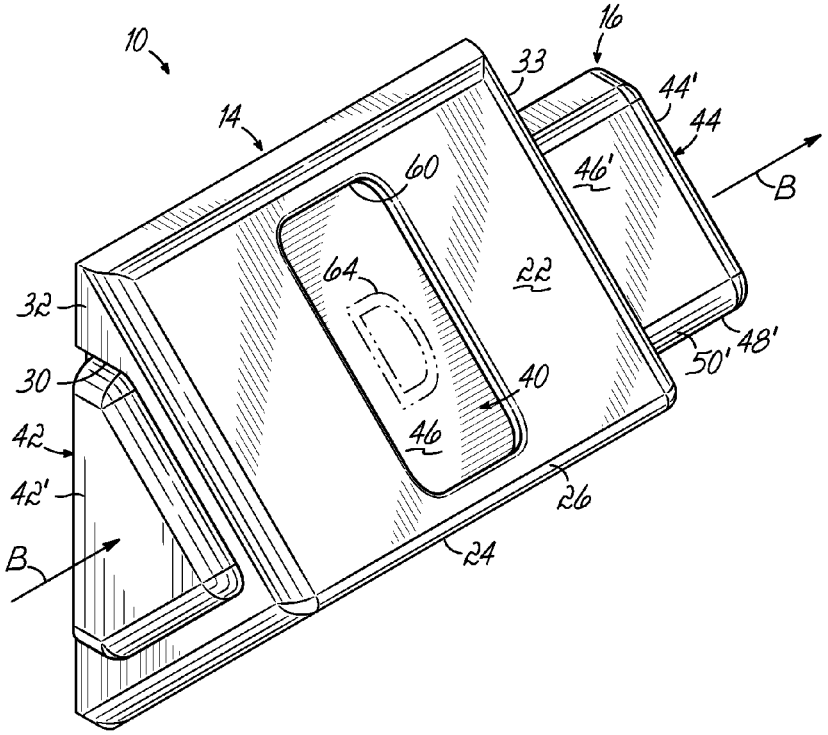
FIG. 2 is a perspective view of the embodiment of the indicator of FIG. 1 with the slidable member positioned to display an indicia indicative of a dirty or ready to load status of a dishwasher in accordance with the principles of the present invention.
Figure 3:
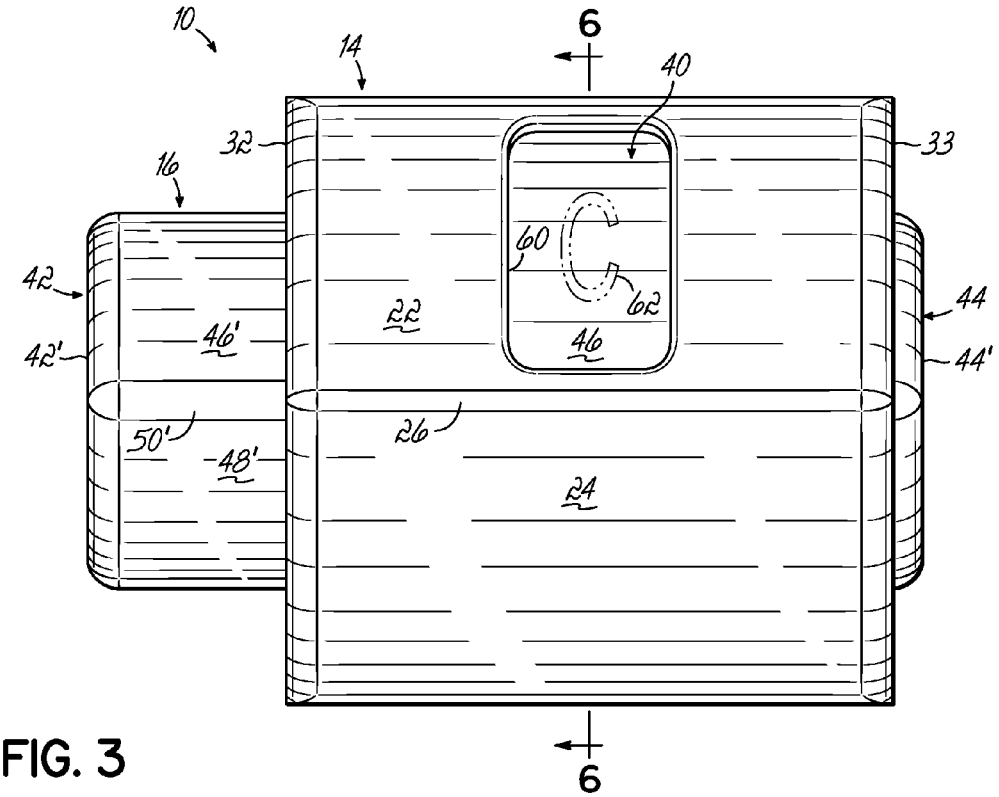
FIG. 3 is a front elevation view of the indicator of FIG. 1.
Figure 4:
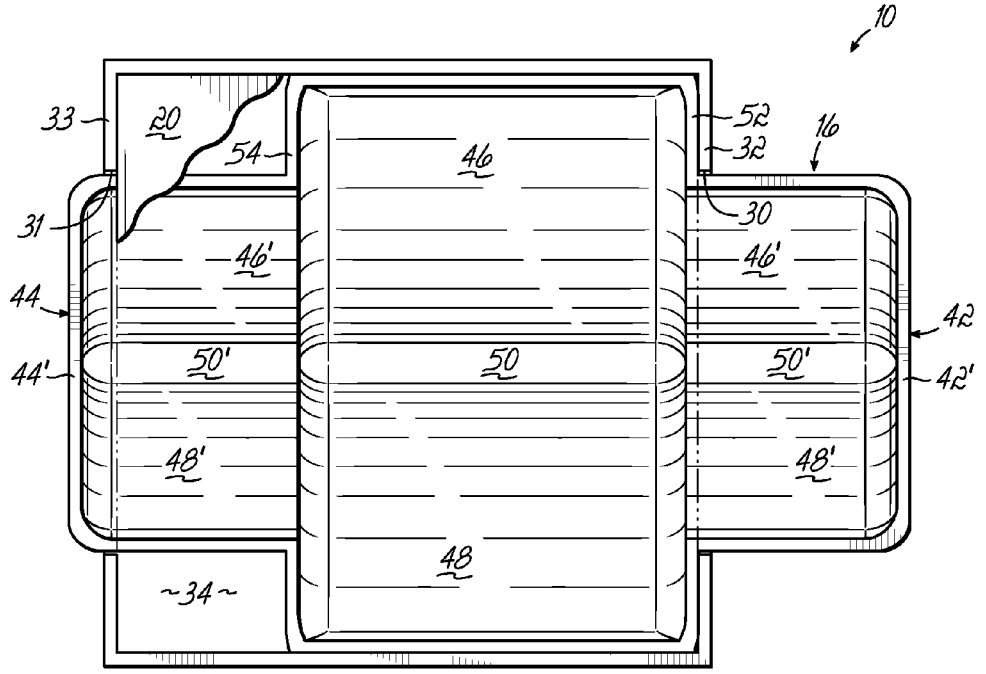
FIG. 4 is a back elevation view, partially cut-away, of the indicator of FIG. 1.

Manual pressure applied to the right end segment 44 such as at end 44', for example, slides the member 16 in the direction of arrows A in FIG. 1 so that the midsection 40, and particularly shoulder 52, moves (from the position in FIG. 2, for example) towards, and possibly against, the left end opening 30 or associated frame segment 32 to a first position (FIG. 1) of the member 16 with the first indicia 62 viewable in the viewing window 60, and with the left end segment 42 extending out well beyond left end opening 30. Right end segment 44 may move close to or flush with right end opening 31, although, advantageously, at least end 44' thereof will extend outside of right end opening 31. However, right end segment 44 could alternatively be positioned into area 34 of the housing 14 in the first position of the member 16. Similarly, manual pressure applied to the left end segment 42 such as at end 42', for example, slides the member 16 in the direction of arrows B in FIG. 2 so that the midsection 40, and particularly shoulder 54, moves (from the position in FIG. 1, for example) towards, and possibly against, the right end opening 31 or associated frame segment 33 to a second position (FIG. 2) of the member 16 with the second indicia 64 viewable in the viewing window 60 and with the right end segment 44 extending out well beyond right end opening 31. Left end segment 42 may move close to or flush with left end opening 30, although, advantageously, at least end 42' thereof will extend outside of left end opening 30. However, left end segment 42 could, alternatively, be positioned into area 34 of the housing 14 in the second position of the member 16.

Figure 8:
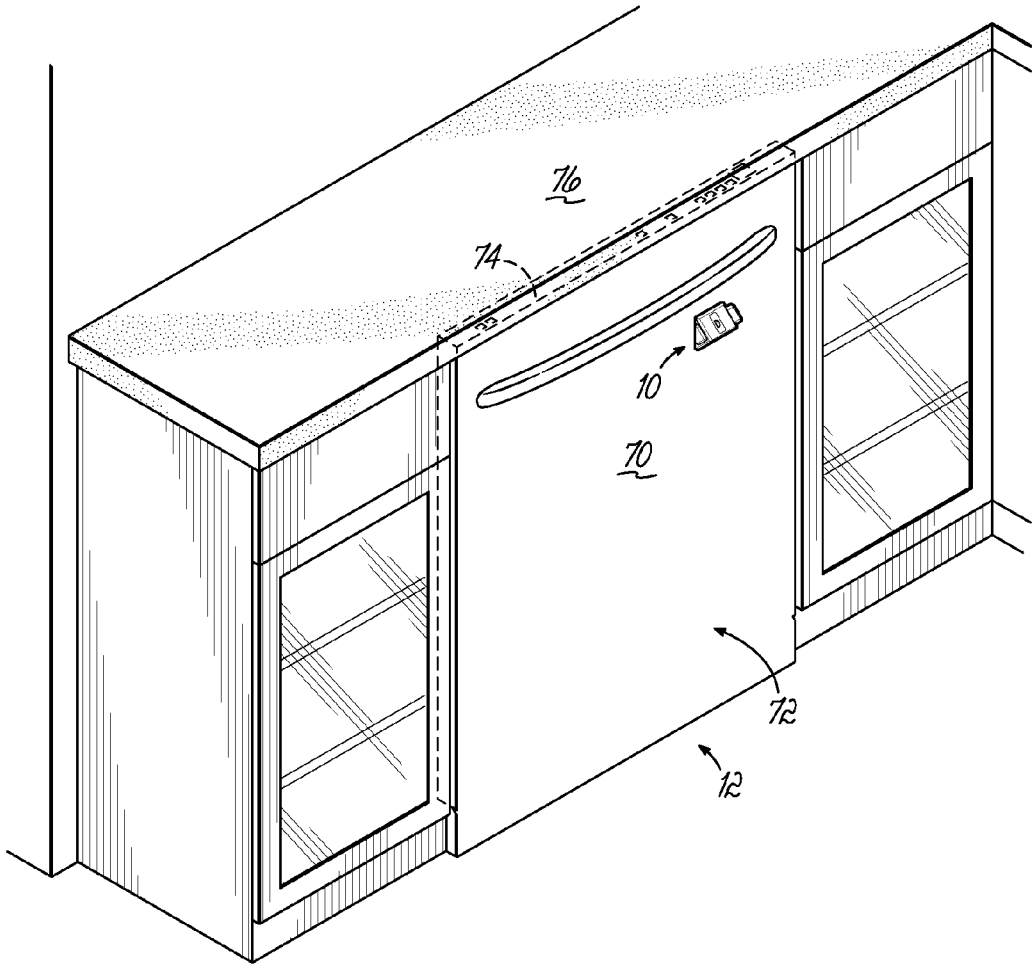
FIG. 8 is a perspective view of the indicator of FIG. 1 held to a dishwasher door front for purposes of explaining the principles of the present invention.

The rear aspect 20 is adapted to be held to a dishwasher 12, and advantageously, the front 70 of the door 72 thereof, below the top 74 of the door which may be below a countertop 76 when the door 72 is closed (see FIG. 8). To that end, a mounting member 80 is associated with the rear aspect 20 of the housing 14 to hold the indicator 10 to the dishwasher door front 70. Mounting member 80 may be a thin, planar web such as a magnet, an aspect of a hook and pile fastener (with the other aspect secured to the door front 70), or a double-sided restickable tape adhered to the rear aspect or wall 20. An adhesive (not shown) may be used to secure the mounting member 80 thereto. The mounting member 80 is advantageously about 1 inch by 1 inch in order to provide sufficient holding size relative to the rear wall 20 which is slightly larger. Other sizes could be used, however. Also, mounting member could instead or could include a suction cup. Some products, such as magnets and hook and pile fasteners, are provided with a sticky, adhesive back to provide their own adhesive. Where a separate adhesive is needed or desired, cyanoacrylate may be used. The restickable tape may be a restickable tab from Scotch, such as their catalog number R100VPC.

The slidable member 16 may be loaded into the housing 14 with the rear aspect 20 removed or hinged open, such that the midsection 40 of the member 16 is within the area 34 of the housing 14, and the left and right segments 42, 44 extend into the left and right end openings 30, 31. The rear wall 32 may then be applied or hinged closed, and secured in place such as by a snap fit and/or with adhesive. The mounting member 80, if included, is exposed at the rear aspect 20 (such as by being adhered to the wall 20) for use in holding the indicator 10 to the dishwasher 12 as above-described.

Advantageously, the indicia 60 and 62 are defined by rectangular areas of respective colors and/or containing lettering or words formed into or placed on the midsection upper wall 46. By way of example, stickers or decals (not shown) could be adhered to upper wall 46. Or, paint or inks could be applied thereto. Still further, the lettering or words, or even the colors, could be placed or created during the molding operation forming the member 16. In an exemplary embodiment, the first indicia 60 might have the color green and/or the letter C or the word CLEAN to indicate the status of the dishwasher 12 as having been run such that the dishes (not shown) therein are clean. The second indicia 62 might have the color red and/or the letter D or L or the word DIRTY or LOAD to indicate the status of the dishwasher 12 as having dirty plates (not shown) therein or otherwise in the loading state before being ready to run and clean the dishes therein. Of course, it will be appreciated that the use of the term dishes herein is meant to be a shorthand term but expansive enough to cover dishes, utensils, and/or any other such items that might be cleaned in the dishwasher 12.

In use, the indicator 10 may be positioned on the door front 70, such that the top wall 22 extends obliquely from the door front 72 to thereby position the viewing window 60 to be readily viewable, and the indicia 62 or 64 therein, by a user (not shown) standing astride the dishwasher door 72 when the dishwasher is closed. The slidable member 16 manipulated to show either indicia 60 or indicia 62 in the viewing window 60 depending on the state of the dishwasher 12. If desired, the indicator 10 can be removed, such as for cleaning and/or repositioning along door 72 (or for positioning elsewhere if desired). The indicator 10 can be cleaned in the dishwasher 12 and then reattached to the door front 70 after cleaning for further use.

While the present invention has been illustrated by description of embodiments, and while the illustrative embodiments have been described in considerable detail, it is not the intention of the inventor to restrict or in any way limit the scope of the appended claims to such detail. Additional advantages and modifications will readily appear to those skilled in the art. For example, although the indicator 10 is adapted to be removably mounted to the dishwasher door, the indicator 10 may also be placed on a countertop 76 or other planar surface near the dishwasher 12. Moreover, the indicator 10 could be supplied without a mounting member 80 (or it could be supplied with, but separate from the indicator 10). The invention in its broader aspects is therefore not limited to the specific details, representative apparatus and methods, and illustrative examples shown and described. Accordingly, departures may be made from such details without departing from the spirit or scope of the general inventive concept.

Having described the invention, what is claimed is:

1. An after-market dishwasher indicator adapted to be held to a dishwasher door front, the indicator comprising:

a housing having left and right ends with corresponding left and right end openings and a rear aspect and a top wall extending between the openings, the rear aspect configured to be applied against a door front of a dishwasher, the top wall extending obliquely from the rear aspect and including a viewing window; and an indicator member slidably positioned between the rear aspect and the top wall and the left and right ends, the member having a left end accessible at the left end opening of the housing and a right end accessible at the right end opening of the housing, the indicator including first and second, different indicia thereon, the member being slidable between first and second positions by manual pressure applied to the left and right ends such that in the first position the first indicia is viewable in the viewing window and in the second position the second indicia is viewable in the viewing window, such that when the rear aspect is held to a dishwasher door front, the viewing window is oblique thereto to be observable by a user standing astride the dishwasher door front wall whereby to facilitate viewing of the indicia.

2. The indicator of claim 1, the left end of the member extending out of the left end of the housing through the left end opening in at least one of the first and second positions and the right end of the member extending out of the housing through the right end opening in at least the other of the first and second positions.

3. The indicator of claim 1, the member having an upper wall confronting the top wall of the housing, the indicia being associated with the upper wall.

4. The indicator of claim 1, the housing including a bottom wall extending between the openings and obliquely from the rear aspect to the top wall, the member being positioned between the rear aspect, top wall, and bottom wall.

5. The indicator of claim 4, the member having an upper wall confronting the top wall of the housing, the indicia being associated with the upper wall, the member having a lower wall confronting the bottom wall of the housing.

6. The indicator of claim 5, the member having an open back and being wider than the housing such that a portion of the member extends out of the housing through one of the left and right openings.

7. The indicator of claim 5, the housing and member having complementary cross-sections.

8. The indicator of claim 7, the member having a midsection that is larger than the left and right side openings, but smaller than a width between the openings whereby to be slidable within the housing between, but not beyond, the openings, the left and right ends of the member being smaller than the openings so as to be extendable therethrough, the indicia being associated with the midsection.

9. The indicator of claim 1, the first and second indicia being laterally adjacent one another.

10. The indicator of claim 1, the left and right openings of the housing each having a shape and the left and right ends of the member each having a cross section complementary to the shape of the respective openings.

11. The indicator of claim 1, the rear aspect of the housing including a solid wall.

12. The indicator of claim 1 further comprising a mounting member associated with the rear aspect and adapted to hold the indicator to a dishwasher door front.

13. The indicator of claim 12, the mounting member being selected from the group consisting of a magnet, an aspect of a hook and pile fastener, a suction cup, and a double-sided restickable tape.

14. The indicator of claim 12 further comprising adhesive securing the mounting member to the rear aspect.

15. The indicator of claim 1, the top wall extending obliquely at an acute angle relative to the rear aspect.

16. An after-market dishwasher indicator adapted to be held to a dishwasher door front, the indicator comprising:

a housing having generally flat rear wall, a generally flat top wall, and a generally flat bottom wall, the top and bottom walls extending obliquely from the rear wall and joining each other to define a generally triangular cross-section to the housing, the housing having left and right end generally triangular shaped openings smaller than the cross section of the housing, the top wall including a viewing window;

an indicator member positioned to be slidable in the housing, the indicator having a midsection and left and right segments, the midsection having an upper wall and a lower wall joined together to define a generally V-shaped cross-section sized to match with the triangular cross-section of the housing, the midsection being shorter in width than the distance between the end openings of the housing and larger than the end openings whereby to be slidable in the housing between, but not beyond, the end openings, the left and right segments each having an upper wall and a lower wall joined together to define a generally V-shaped cross section sized to match with the triangular openings of the housing so as to be slidable therethrough, the midsection of the indicator member including first and second different indicia associated with the upper wall thereof, and sized such that the first indicia is viewable in the viewing window when the member is slid by manual pressure applied to the right segment such that the midsection as against the left opening of the housing and the second indicia is viewable in the viewing window when the member is slid by manual pressure applied to the left segment such that the midsection is against the right opening of the housing; and a mounting member associated with the rear wall and adapted to hold the indicator to a dishwasher door front such that the viewing window is oblique thereto to be observable by a user standing astride the dishwasher door front whereby to facilitate viewing of the indicia.

17. The indicator of claim 16, the mounting member being selected from the group consisting of a magnet, an aspect of a hook and pile fastener, and a suction cup.

18. The indicator of claim 16 further comprising adhesive securing the mounting member to the rear wall.

19. The indicator of claim 16, the mounting member being a double-sided restickable tape.

20. The indicator of claim 19 further comprising adhesive securing a side of the tape to the rear wall.

* * * * *